US008583344B2

(12) United States Patent
Cassani

(10) Patent No.: US 8,583,344 B2
(45) Date of Patent: Nov. 12, 2013

(54) METHOD FOR CONTROLLING GLOW PLUGS IN A DIESEL ENGINE, PARTICULARLY FOR MOTOR-VEHICLES

(75) Inventor: Stefano Cassani, Turin (IT)

(73) Assignee: GM Global Technology Operations LLC, Detroit, MI (US)

( * ) Notice: Subject to any disclaimer, the term of this patent is extended or adjusted under 35 U.S.C. 154(b) by 200 days.

(21) Appl. No.: 13/140,367

(22) PCT Filed: Oct. 16, 2009

(86) PCT No.: PCT/EP2009/007425

§ 371 (c)(1),
(2), (4) Date: Jun. 16, 2011

(87) PCT Pub. No.: WO2010/069423

PCT Pub. Date: Jun. 24, 2010

(65) Prior Publication Data

US 2011/0251774 A1 Oct. 13, 2011

(30) Foreign Application Priority Data

Dec. 18, 2008 (GB) ..... 0823100.3

(51) Int. Cl.
*F02P 19/02* (2006.01)

(52) U.S. Cl.
USPC ..... 701/102; 123/145 A; 219/268

(58) Field of Classification Search
USPC ..... 701/102; 123/145 A, 145 R; 219/268, 219/270
See application file for complete search history.

(56) References Cited

U.S. PATENT DOCUMENTS

| | | | | |
|---|---|---|---|---|
| 4,624,226 | A * | 11/1986 | Klak et al. | 123/179.21 |
| 4,862,370 | A * | 8/1989 | Arnold et al. | 701/113 |
| 5,122,968 | A * | 6/1992 | Bauer et al. | 702/58 |
| 5,372,102 | A | 12/1994 | Schmid et al. | |
| 5,729,456 | A * | 3/1998 | Boisvert et al. | 701/99 |
| 5,937,814 | A * | 8/1999 | Baumer et al. | 123/179.21 |
| 6,164,258 | A * | 12/2000 | Petrovich et al. | 123/179.6 |
| 7,881,851 | B2 * | 2/2011 | Kernwein et al. | 701/102 |
| 8,280,609 | B2 * | 10/2012 | Ehlert | 701/102 |
| 2005/0039732 | A1 * | 2/2005 | Toedter et al. | 123/605 |
| 2007/0240663 | A1 * | 10/2007 | Hiramatsu | 123/179.6 |
| 2008/0104943 | A1 * | 5/2008 | Frank et al. | 60/284 |

(Continued)

FOREIGN PATENT DOCUMENTS

| | | | |
|---|---|---|---|
| DE | 3608602 | A1 | 9/1987 |
| EP | 0288085 | A2 | 10/1988 |

(Continued)

OTHER PUBLICATIONS

Mercedes Benz W123 glow plug operational manual pp. 13 and 14 dated 1985.*

(Continued)

*Primary Examiner* — Stephen K Cronin
*Assistant Examiner* — Arnold Castro
(74) *Attorney, Agent, or Firm* — Ingrassia Fisher & Lorenz, P.C.

(57) ABSTRACT

A method for controlling glow plugs associated with respective cylinders of a Diesel engine, which includes, but is not limited to the steps of storing data indicative of the activation sequence of the cylinders and activating sequentially each glow plug according to the stored activation sequence of the cylinders.

9 Claims, 6 Drawing Sheets

(56) References Cited

U.S. PATENT DOCUMENTS

| | | | | |
|---|---|---|---|---|
| 2009/0012695 | A1* | 1/2009 | Kernwein et al. | 701/102 |
| 2009/0289048 | A1* | 11/2009 | Casasso et al. | 219/262 |
| 2010/0094523 | A1* | 4/2010 | Kernwein et al. | 701/102 |
| 2010/0094524 | A1 | 4/2010 | Ehlert | |
| 2010/0103576 | A1* | 4/2010 | Sugimoto et al. | 361/84 |
| 2011/0108540 | A1* | 5/2011 | Kernwein et al. | 219/268 |
| 2011/0118952 | A1* | 5/2011 | Fink et al. | 701/102 |
| 2011/0118964 | A1* | 5/2011 | Tanaka et al. | 701/113 |
| 2011/0251774 | A1* | 10/2011 | Cassani | 701/102 |

FOREIGN PATENT DOCUMENTS

| | | | |
|---|---|---|---|
| FR | 2568630 | A1 | 2/1986 |
| JP | 2008297925 | A | 12/2008 |
| WO | 2008110143 | A1 | 9/2008 |

OTHER PUBLICATIONS

International Searching Authority, International Search Report for Application No. PCE/EP2009/007425, dated Feb. 3, 2011.

* cited by examiner

METHOD FOR CONTROLLING GLOW PLUGS IN A DIESEL ENGINE, PARTICULARLY FOR MOTOR-VEHICLES

CROSS-REFERENCE TO RELATED APPLICATIONS

This application is a U.S. National-Stage entry under 35 U.S.C. §371 based on International Application No. PCT/EP2009/007425, filed Oct. 16, 2009 which was published under PCT Article 21(2) and which claims priority to British Application No. 0823100.3, filed Dec. 18, 2008, which are all hereby incorporated in their entirety by reference.

TECHNICAL FIELD

The present invention relates to a method for controlling glow plugs in a Diesel engine, particularly for motor-vehicles.

BACKGROUND

Glow plugs are typically associated with the cylinder chambers of Diesel engines, and provide a general combustion aid during the engine ignition and also when the engine is running during the engine warm-up phase.

The glow plugs are controlled by an associated electronic control module which is arranged to control in real time the amount of energy transferred to each glow plug, so as to reach and hold a predetermined working temperature.

The electronic control module controls a power circuit which is arranged to supply the glow plugs with a nominal supply voltage so that each glow plug reaches the predetermined working temperature. The electronic control module performs therefore the activation of the glow plugs by driving electronic switches, generally MOSFET transistors, by means of pulse-width-modulated (PWM) control signals.

The glow plugs have a tip which sticks out into the combustion chamber and which is arranged to perform an electrical to thermal power conversion thus rising its temperature up to high values, for example up to approximately 900° C.

As a consequence of this high temperature of the tip, the temperature of the air around the tip increases; the presence of this hot point in the combustion chamber aids the combustion process.

Each cylinder is equipped with one glow plug which is turned on according to the engine and environmental conditions, for example when the engine is cold.

Glow plugs are electrical resistors, in particular temperature variable resistors: when the temperature increases, the internal resistance increases too.

There are different types of glow plugs:

High/Low voltage glow plugs: the difference between said two types is based on the nominal supply voltage that must be provided to the glow plug. High voltage glow plugs need typically a voltage of approximately 11V, low voltage glow plugs need typically a voltage of approximately 4-5V. High voltage glow plugs are preferably supplied directly by the vehicle battery, while low voltage glow plugs are preferably supplied by means of pulse-width-modulated (PWM) control signals as they have a nominal voltage lower than the battery voltage.

Metallic/Ceramic glow plugs: the difference between said two types is based on the material used for producing the glow plug.

In FIG. 1 is shown a schematic block diagram of a glowing system comprising low voltage glow plugs.

An engine block 2 comprises a plurality of cylinders 4 defining respective combustion chambers.

Glow plugs 6 are placed with their tips 8 in the combustion chambers of the cylinders 4 and have one terminal connected to the engine block 2 which is in turn connected to a DC voltage supply B, such as the battery of the vehicle, by a conductor 10.

The glow plugs 6 have also another terminal connected to a respective output terminal 14-20 of an electronic control module 22.

The electronic control module 22 comprises a plurality of electronic switches 24, one for each glow plug 6, having each the drain-source path connected essentially in series with a respective glow plug 6, between the terminals of the voltage supply B.

The electronic switches 24 are, for instance, MOSFET transistors, and are supplied with PWM control signals 26 applied to their gates.

The vehicle is provided with an engine control unit (ECU), not shown in the drawings, arranged to evaluate the need to switch-on the glow plugs. If the glow plugs are switched on, the ECU communicates to the driver, for instance through a specific board lamp, to await a predetermined time interval, the so called pre-ignition time, before starting the engine. This is done in order to get the glowing system ready, i.e. let the glow plugs become hot, to support the engine ignition.

Low voltage glow plugs are conventionally supplied with a voltage higher than their nominal one, in order to reduce the pre-ignition time thus improving the glowing system quickness. This high voltage is supplied for a short time so as to reach as fast as possible the glow plug working temperature, then the voltage is stepped down to the nominal value in order to keep the temperature reached. This voltage regulation is obtained by supplying PWM voltage signals having different targets of effective voltage.

A common drawback of the procedure above disclosed is that it causes a very high current and power consumption at the beginning of the activation of the glow plugs. Particularly, the total current peak is of about 150 A and the total power peak is of about 1700 W. This affects particularly ceramic low voltage glow plugs, which have a very low electrical resistance at ambient conditions. When the glow plug temperature increases, and the glow plug electrical resistance increases too, the current and power consumption decreases.

Due to the above disclosed drawback, the power circuit must to be designed to support such high current and power, thus requiring expensive components.

Furthermore, even if a high voltage is applied at the beginning of the activation phase of the glow plugs, the pre-ignition time is not completely eliminated because, especially in cold conditions, the glow plugs require time to be warmed-up.

In view of the above, it is at least one object of the present invention to provide an improved method and an improved apparatus for controlling glow plugs in a Diesel engine, allowing to overcome the above-outlined inconveniences of the prior art systems. In addition, other objects, desirable features and characteristics will become apparent from the subsequent detailed description, and the appended claims, taken in conjunction with the accompanying drawings and this background.

BRIEF DESCRIPTION OF THE DRAWINGS

The present invention will hereinafter be described in conjunction with the following drawing figures, wherein like numerals denote like elements, and.

DETAILED DESCRIPTION

The following detailed description is merely exemplary in nature and is not intended to limit application and uses. Furthermore, there is no intention to be bound by any theory presented in the preceding background or summary or the following detailed description.

In the present description and in the annexed claims by the expression "key-on action" it is generally meant an action by which in a vehicle powered by a Diesel engine with a conventional glowing system the user determines the activation of the glow plugs associated with the engine.

In such a motor vehicle having a conventional key-operated ignition and starting switch, such a "key-on action" is represented by the introduction and rotation of the key to the so-called "on" position, i.e. a position in which the ignition and starting switch allows on-board electrical systems to be supplied with power from the battery and causes the glow plugs to be activated.

In vehicles which are not provided with such an ignition and starting switch, by "key-on action" it is meant any equivalent action, performed also with means different from a key, and capable of causing, in a conventional glowing system for a Diesel engine, the activation of the glow plugs.

Briefly, the method according to the present invention consists in that the glow plugs 6 are activated in sequence, one after the other, and not contemporaneously, after a driver key-on action. So, it is not anymore necessary to supply the glow plugs 6 with a great quantity of energy, thus leading to a significant reduction of the electrical power consumption during the activation phase. As a result, the power circuit design is improved and simplified.

Figure 1:
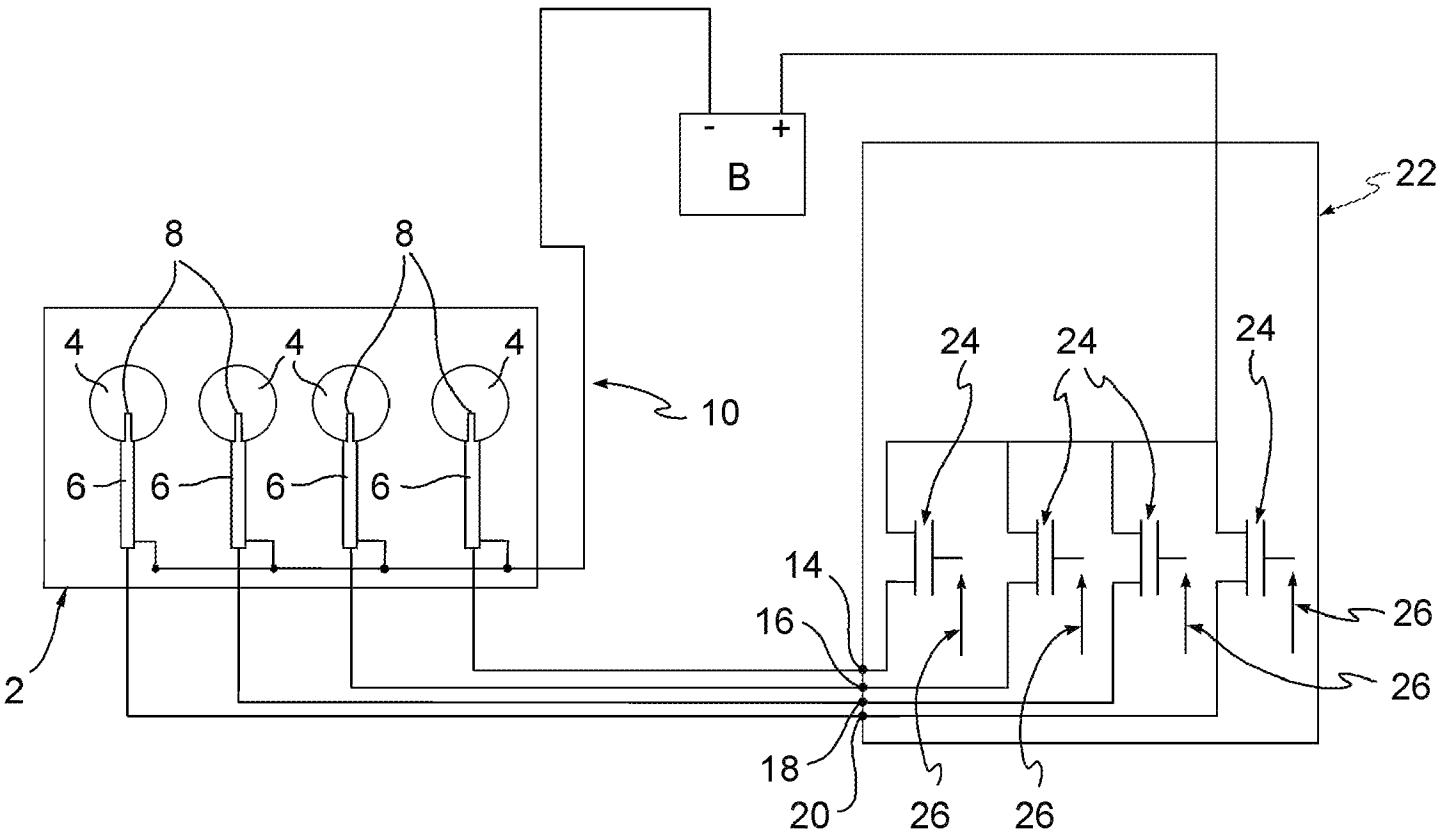
FIG. 1 (PRIOR ART)
FIG. 1, is a schematic block diagram of a glowing system comprising low voltage glow plugs.
Figure 2:
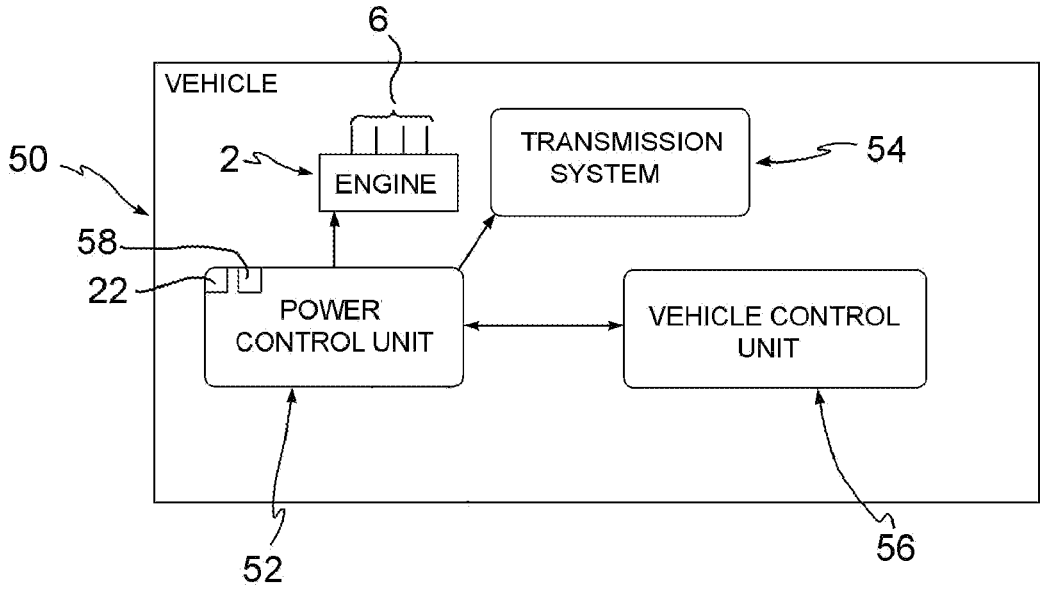
FIG. 2 is block diagram of a vehicle 50 using a method according to an embodiment of the invention.

In FIG. 2 is shown a block diagram of a vehicle 50 using a method according to the invention. The vehicle 50 comprises a power control unit 52 arranged to control an engine 2, having a plurality of glow plugs 6, and a transmission system 54 of the vehicle 50. The vehicle 50 further comprises a vehicle control unit 56 arranged to detect the driver key-on action. The power control unit 52 comprises an electronic control module 22 for driving the glow plugs 6.

The vehicle control unit 56 detects the occurrence of a driver key-on action and then activates the power control unit 52 which in turn starts the engine 2.

The power control unit 52 further comprises a memory 58 for storing data indicative of the activation sequence of the cylinders 4, i.e., data indicating the order in which the cylinders 4 must be activated as soon as the engine is started. In fact, engine cylinders 4 do not fire all at the same time but they are activated in a sequence.

The glow plugs 6 can therefore be activated individually in a predetermined sequence, i.e., the same sequence in which the cylinders 4 must be activated, without affecting the glowing system quickness. The activation of the glow plugs 6 is performed in a sequential manner because the engine 2 does not need to have all the glow plugs 6 hot at the same time.

During the cranking of the engine 2, the engine speed is quite lower than when the engine 2 is running, for example, during the cranking phase the engine speed is approximately 200 rpm while during the running phase the engine speed is above approximately 800 rpm. This allows a time delay, between the activation of each cylinder 4, quite high, for example approximately 100 ms, so allowing to shift the activation of each glow plug 6 without affecting the performance of the engine 2.

The time delay between one activation and the next one is a predetermined value defined by the power control unit 52 in dependence of engine conditions, for example the engine coolant temperature, the air temperature or the engine starter motor speed. The optimal delay is a trade off between the quickness requested, the power circuit electrical power limits and the maximum delay applicable without affecting the glowing quickness. The first two parameters depend on the environmental factors while the third parameter is mainly related to the engine speed during the cranking phase.

In FIGS. 3-6 are illustrated a plurality of graphs showing the results of the method according to an embodiment of the invention.

Figure 3:
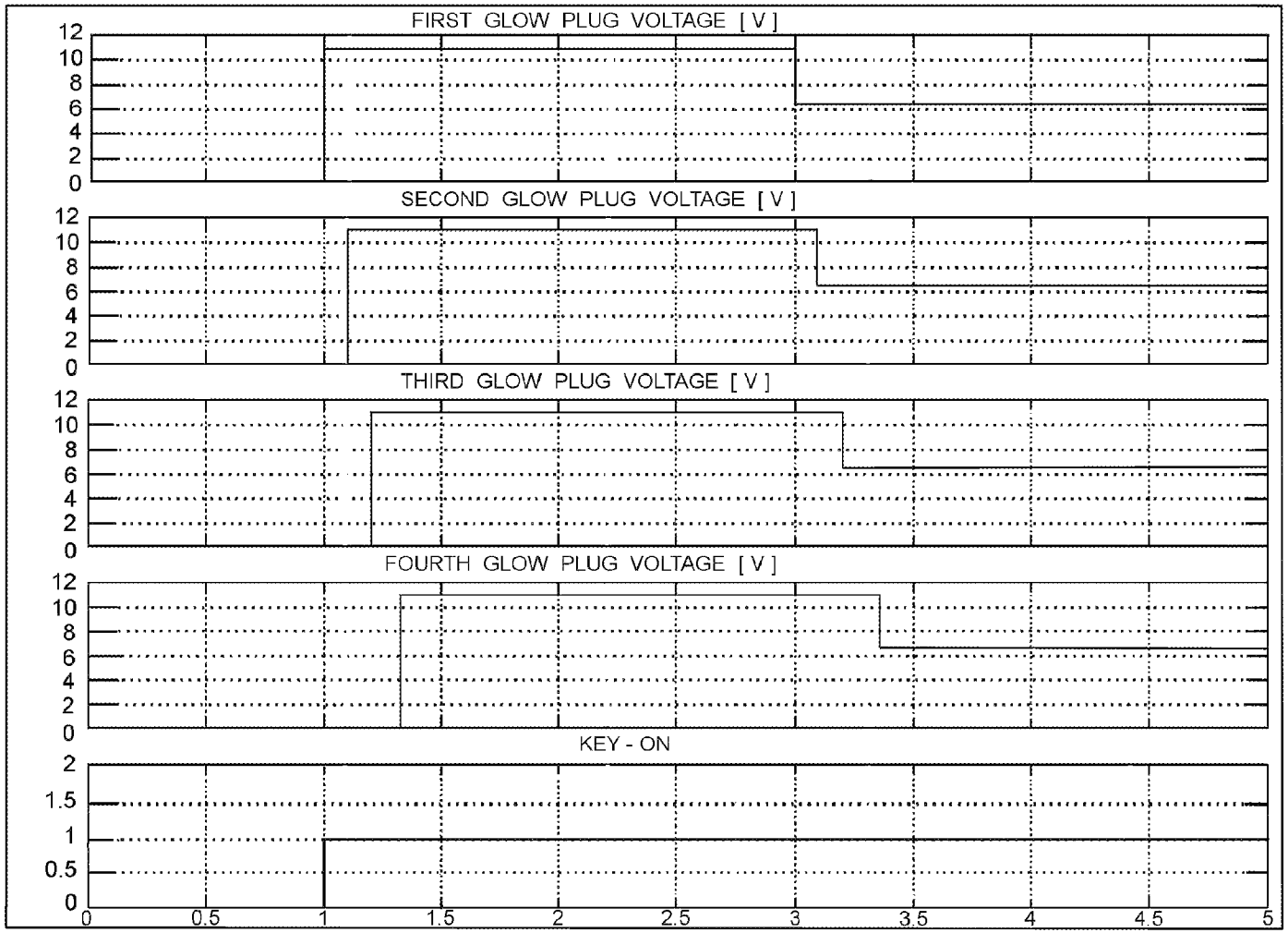
FIGS. 3-6 show a plurality of graphs illustrating the results of the method according to an embodiment of the invention.

In FIG. 3 a first, a second, a third and a fourth graph show the voltage across four different glow plugs 6: as it can be noted, the voltage is applied to each glow plug 6 in a sequential manner, and the voltage increase begins in the first glow plug 6 when the power control unit 52 detects the driver key-on action, shown in a fifth graph of said FIG. 3.

Figure 4:
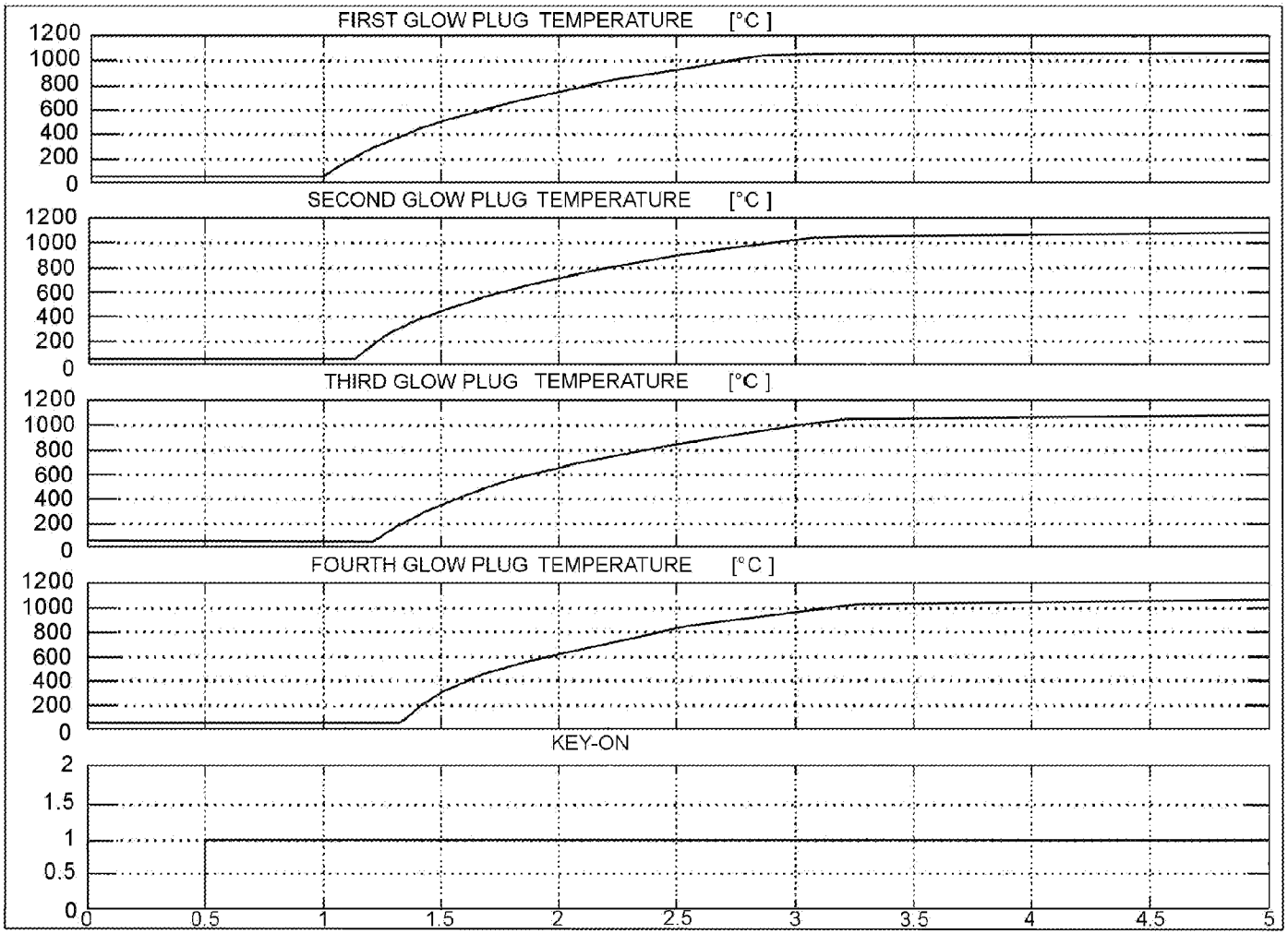

In FIG. 4 a first, a second, a third and a fourth graph show the temperature in the four different glow plugs 6: when each glow plug 6 is supplied with a high voltage, the temperature starts to increase until it reaches the predetermined working temperature; at this moment, the voltage is lowered to the nominal value necessary to keep said working temperature (see FIG. 3). A fifth graph shows the driver key-on action.

Figure 5:
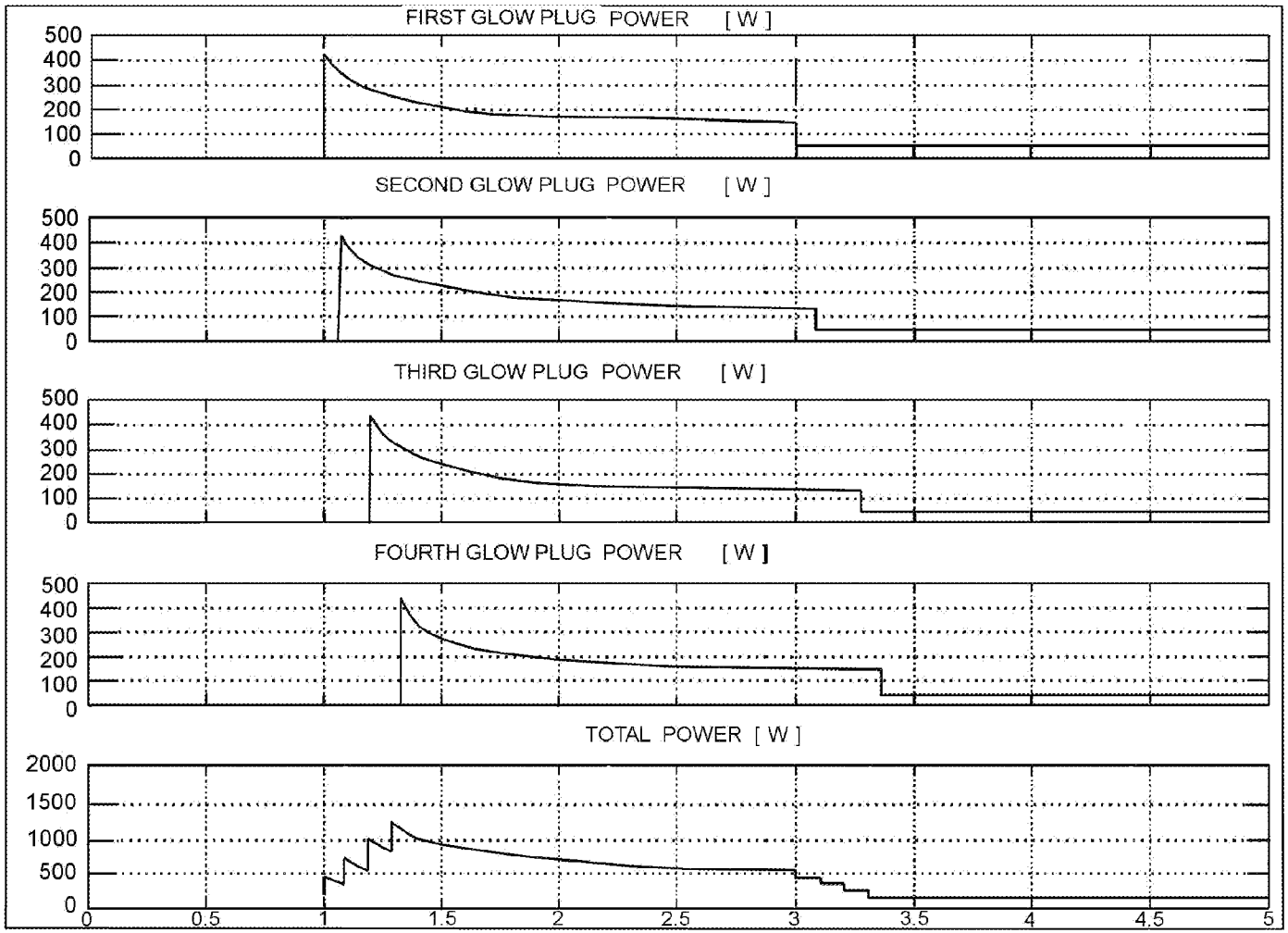

In FIG. 5 a first, a second, a third and a fourth graph show the power dissipated in the four glow plugs 6. A fifth graph shows the total power peak which is lower than the corresponding value of the prior art systems, for instance approximately 1700 W.

Figure 6:
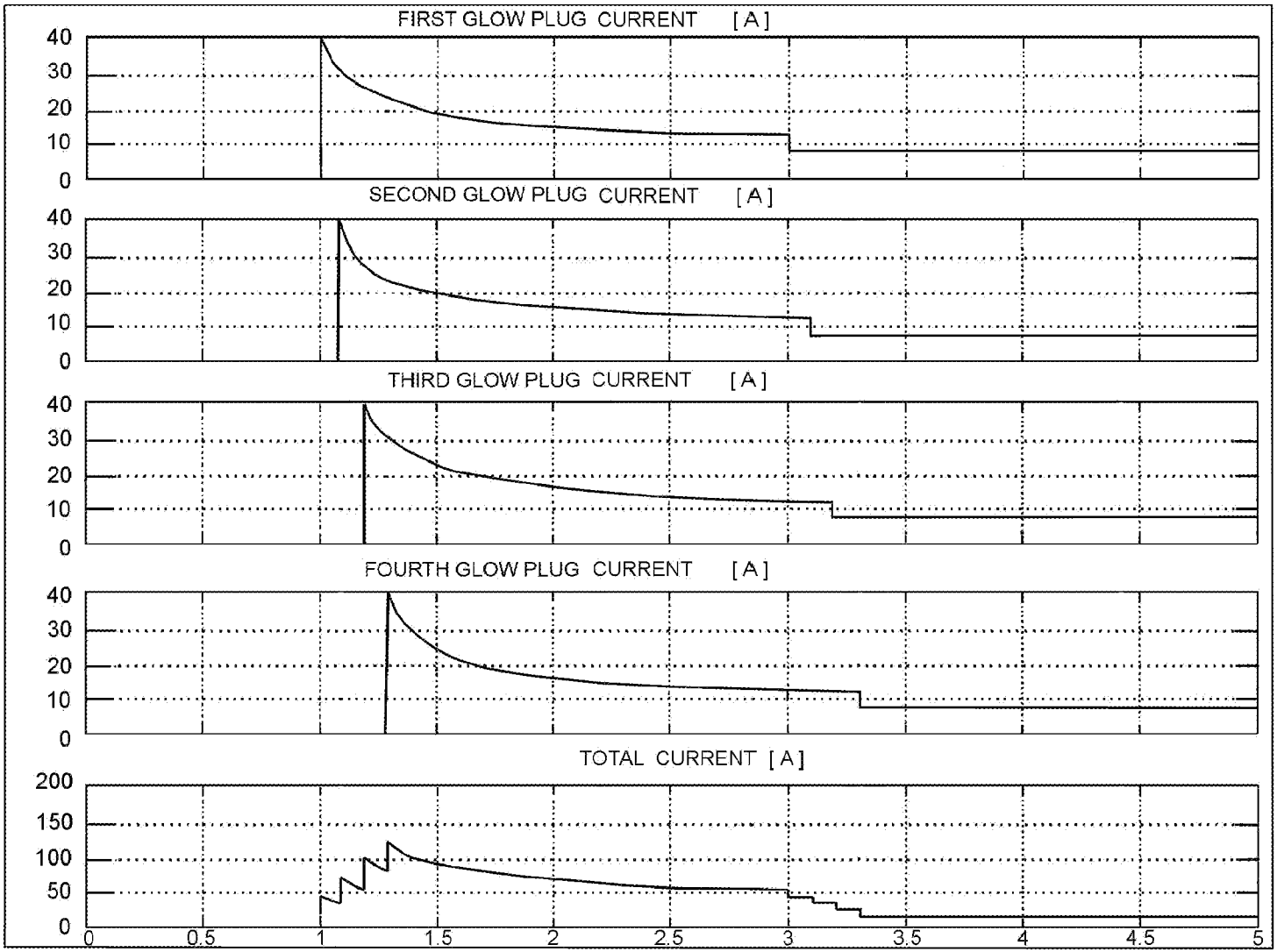

In FIG. 6 a first, a second, a third and a fourth graph show the current dissipated in the four glow plugs 6. A fifth graph shows the total current peak which is lower than the corresponding value of the prior art systems, for instance approximately 150 W.

Clearly, provided that the principle of the invention is retained, the forms of embodiment and the details of manufacture may vary greatly from what has been described and illustrated purely by way of non-restrictive example, without thereby departing from the scope of the invention as defined in the accompanying claims. Moreover, while at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration in any way. Rather, the foregoing detailed description will provide those skilled in the art with a convenient road map for implementing an exemplary embodiment it being understood that various changes may be made in the function and arrangement of elements described in an exemplary embodiment without departing from the scope as set forth in the appended claims and their legal equivalents.

The invention claimed is:

1. A method for controlling glow plugs associated with cylinders of a Diesel engine, comprising:

storing data indicative of an activation sequence of the cylinders;

activating sequentially each of the glow plugs according to the stored data indicative of the activation sequence of the cylinders, wherein a predetermined time interval is set between the activating sequentially each of the glow plugs, and wherein the predetermined time interval is defined in dependence of engine conditions.

2. The method according to claim 1, wherein the engine conditions includes an engine coolant temperature.

3. The method according to claim 1, wherein the engine conditions includes an air temperature.

4. The method according to claim 1, wherein the engine conditions includes an engine starter motor speed.

5. The method according to claim 1, wherein the engine conditions includes an engine coolant temperature, an air temperature, and an engine starter motor speed.

6. The method according to claim 1, further comprising detecting a driver key-on action before the activating sequentially each of the glow plugs.

7. The method according to claim 6, wherein the engine is associated to key-operated ignition and a starting mechanism, and wherein the key-on action is represented by an introduction of a key into said ignition and starting mechanism and a rotation of said key to a predetermined on position, said predetermined on position indicative of a position in which the ignition and starting mechanism initiates activation of the glow plugs.

8. The method according to claim 1, wherein the step of storing data indicative of the activation sequence of the cylinders is performed by a memory associated with a first control unit; and the step of activating sequentially each of the glow plugs is performed by said first control unit.

9. The method according to claim 8, wherein the step of detecting a driver key-on action is performed by a second control unit, said second control unit configured to activate the first control unit.

* * * * *